US007611020B2

(12) United States Patent
Prest

(10) Patent No.: US 7,611,020 B2
(45) Date of Patent: Nov. 3, 2009

(54) RAPIDLY ASSEMBLEABLE AND DISASSEMBLEABLE DISPLAY RACK

(76) Inventor: J. David Prest, 1412 E. Whalers Way, Tempe, AZ (US) 85283

( * ) Notice: Subject to any disclaimer, the term of this patent is extended or adjusted under 35 U.S.C. 154(b) by 584 days.

(21) Appl. No.: 11/343,246

(22) Filed: Jan. 30, 2006

(65) Prior Publication Data

US 2007/0175847 A1 Aug. 2, 2007

(51) Int. Cl.
*A47F 5/00* (2006.01)

(52) U.S. Cl. ..... 211/195; 211/181.1; 211/183

(58) Field of Classification Search ..... 211/133.2, 211/186, 149, 151, 195, 118, 189, 181.1, 211/13.1, 194, 199, 183; 280/79.11, 79.2; 108/181, 193, 109, 107, 106, 157.13, 157.14, 108/91, 118; 24/298, 300, 301, 302, 68 CD; 248/165, 166, 164, 235, 247, 241; 119/467, 119/468, 473, 452, 459, 461, 474; D6/499, D6/470, 487; 312/213; 5/620, 191, 195, 5/196, 236.1, 237; 206/736, 740, 744; 220/527, 220/554, 629, 630; 297/452.63; 229/122.23, 229/122.22, 122.25; 40/780, 782, 786, 787, 40/606.17, 124.14–124.16, 675, 750, 538, 40/539

See application file for complete search history.

(56) References Cited

U.S. PATENT DOCUMENTS

| | | | | | |
|---|---|---|---|---|---|
| 918,415 | A * | 4/1909 | Berger | 248/247 |
| 1,511,815 | A * | 10/1924 | Markow | 245/2 |
| 1,938,970 | A * | 12/1933 | Moog | 211/60.1 |
| 2,964,329 | A * | 12/1960 | Beck | 280/79.2 |
| 3,856,322 | A * | 12/1974 | Bestehorn | 280/79.11 |
| 3,908,564 | A * | 9/1975 | Miller et al. | 108/162 |
| 4,155,311 | A * | 5/1979 | Jackovin | 108/190 |
| 4,523,526 | A * | 6/1985 | O'Neill | 108/149 |
| 4,595,106 | A * | 6/1986 | Kunze et al. | 211/118 |

(Continued)

*Primary Examiner*—Jennifer E. Novosad
(74) *Attorney, Agent, or Firm*—The von Hellens Law Firm, Ltd.

(57) ABSTRACT

Opposed walls of three hingedly attached grid walls are secured to one another by a first strap having folded back ends for partially encircling a segment of a wire element of each opposed grid wall. A second strap is placed adjacent the first strap with the ends of the second strap bearing against the partially encircled wire elements to retain the wire elements within the respective folded back ends. Nylon ties or bolts may be used to secure the first and second straps to one another. Two or more pairs of first and second straps support a grid wall serving as a shelf and the shelf may be secured to the straps by pairs of nylon ties. To provide mobility to the display rack, fixed or pivotable wheels are supported by the lowermost pairs of first and second straps and may be secured thereto by nylon ties or by nut and bolt combinations. A billboard unit having four panels is formed by two three-segmented panels placed orthogonally upon one another to permit upward bending of the pairs of outer panels. A slide having two orthogonal channels interconnect with and retain adjacent edges of the upwardly bent panels. The billboard unit may be secured in place at the top of the display rack with nylon ties. To disassemble the display rack, each nylon tie is snipped to permit removal of the elements of the display rack and the first and second straps a re disengaged from one another, whereby the display rack is quickly dismantled for storage and/or transport.

11 Claims, 14 Drawing Sheets

U.S. PATENT DOCUMENTS 4,878,682 A * 11/1989 Lee ..... 280/42
4,927,074 A * 5/1990 LaRue et al. ..... 229/125.21
4,978,013 A * 12/1990 Hogg ..... 211/133.2
5,146,635 A * 9/1992 Gastle et al. ..... 5/620
6,082,825 A * 7/2000 Simon ..... 297/452.63
6,263,573 B1 * 7/2001 Bullard ..... 29/896.92
6,443,321 B1 * 9/2002 Felsenthal ..... 211/195
6,547,195 B1 * 4/2003 Kokuzian et al. ..... 248/129
2001/0008251 A1 * 7/2001 Tsubaki et al. ..... 229/122.23
2006/0097487 A1 * 5/2006 Stuart et al. ..... 280/651

* cited by examiner

RAPIDLY ASSEMBLEABLE AND DISASSEMBLEABLE DISPLAY RACK

BACKGROUND OF THE INVENTION

1. Field of the Invention

The present invention relates to display racks, and, more particularly, to display racks which are light in weight and quickly assembleable and disassembleable.

2. Description of Related Prior Art

At trade shows and the like, manufacturers and distributors of various products or services usually display their wares on display racks of various types. These display racks tend to be large, cumbersome and heavy, which features render them difficult to handle during set up and take down. Of the display racks presently available that are disassembleable for storage and/or transport, tools, such as screwdrivers, pliers, wrenches, etc. are often required to be used. Numerous parts, such as nuts and bolts, are time consuming to attach and detach from the corresponding elements; moreover, they are easily lost which may compromise the integrity of the display rack.

The weight and size of presently used display racks at trade shows and the like are heavy. In a disassembled state, such display racks may require a plurality of containers to receive the various parts in order to render each container sufficiently light to be manageable by persons of normal strength and dexterity. The multiplicity of containers and corresponding weights impose severe restrictions upon ease of transport and storage.

In more permanent locations for display racks, such as in stores, weight and difficulty of assembly and disassembly is less important. Nevertheless, stores tend to have temporary sales of certain items that are preferably displayed at various locations in a store. As such display racks are of a more temporary nature, a relatively lightweight and easily assembleable and disassembleable rack would be of significant benefit to personnel of the store. Thereby, the display racks could be easily assembleable and disassembleable without consuming much time of the sales personnel and permit them to perform their primary function with little disruption. Moreover, storage during non use would be advantageous.

SUMMARY OF THE INVENTION

The present invention is directed to a lightweight, easily assembleable and disassembleable display rack having particular utility at temporary locations, such as trade shows and the like. The display rack is assembleable from a plurality of essentially planar elements that are readily and compactly placed within a container for storage and/or transport purposes. During assembly, the various elements are readily either mechanically locked into place or secured in place by nylon ties or the like. During disassembly, mechanical unlocking is easily done and the nylon ties may be snipped to disengage the respective elements from one another. More particularly, a pair of grid walls, which are light in weight, are hingedly attached to a rear grid wall to provide the back and sides of the display rack. The sides of the display rack are retained in place by pairs of straps wherein a first strap includes folded back ends for receiving a wire element of the side grid walls and a second strap mates with the folded back ends to capture the wire elements within the folded back ends. A light weight shelf in the form of a grid wall is secured to supporting straps by nylon ties or the like.

The number and spacing between the shelves is variable as a function of the configuration of the back and side grid walls and wares to be displayed. A four panel billboard unit for placement on top of the display rack is formed by a pair of three segmented panels placed orthogonal with one another to permit upward bending of the outer panels. A slide engages the edges of each pair of panels abutting one another to retain the billboard unit rigid. The billboard unit may be attached to the top of the rack by nylon ties. To afford mobility to the display rack, pivotable wheels may be either attached to or formed as part of each pair of first and second straps that are mounted at the bottom of the grid walls.

It is therefore a primary object of the present invention to provide an easily assembleable and disassembleable display rack.

Another object of the present invention is to provide an assembleable display rack which incorporates mechanically lockable elements and nylon ties.

Yet another object of the present invention is to provide a display rack which is easily assembleable and and disassembleable by use of mechanically lockingly engaging elements and nylon ties that may be easily unlocked and snipped, respectively, to disassemble the display rack.

Still another object of the present invention is to provide an easily assembleable and disassembleable display rack that may be customized to meet particular needs for size and shelf spacing.

A further object of the present invention is to provide a display rack which is assembleable by use of nylon ties and disassembleable by simply snipping the nylon ties.

A yet further object of the present invention is to provide a display rack which is light in weight yet robust and easily placed in a container for storage and/or transport purposes.

A still further object of the present invention is to provide a method for assembling and disassembling a display rack.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
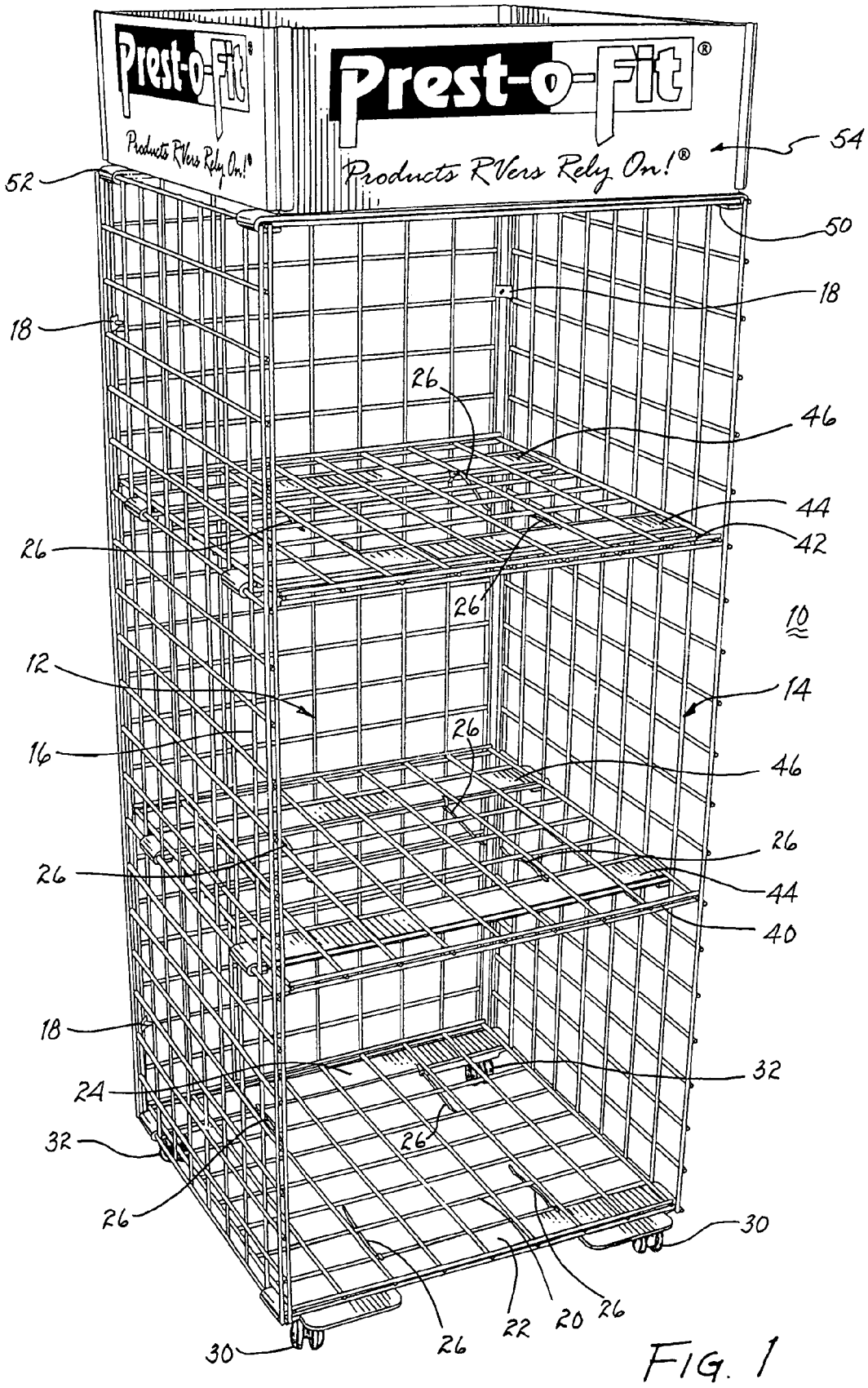
FIG. 1 illustrates a display rack constructed in accordance with the present invention.

Referring to FIG. 1, there is illustrated a display rack 10 embodying the principles of the present invention. The display rack includes a rear grid wall 12 and a pair of side grid walls 14, 16 are hingedly attached to the back grid walls by commercially available hinges 18 conventionally used for this purpose. A bottom shelf 20 of grid wall material is supported upon strap units 22, 24 that engage side grid walls 14, 16. The shelf may be attached to the strap units by nylon ties 26. Strap unit 22 may support a pair of wheel assemblies 30 and strap unit 24 supports a pair of wheel assemblies 32. Thereby, display rack 10 may be easily moved from one location to another.

Further shelves of grid wall material, such as shelves 40, 42 are supported by strap units 44, 46 at vertical locations commensurate with the items to be placed thereon. Like bottom shelf 20, shelves 40, 42 are secured to strap units 44, 46 by nylon ties 26. A pair of strap units 50, 52 secure the upper ends of side grid walls 14,16 rigidly relative to one another. These strap units may also be used to support a billboard unit 54 mounted at the top of display rack 10. One of the main purposes of the present invention is that of providing a relatively light weight display rack adaptable to various configurations as a function of the items to be displayed thereon or to be supported thereby. A further purpose of the present invention is that of providing a display rack which is easily assembleable at a point of use, such as at a booth in a trade show wherein the use is relatively short term. Along with ease of assembly, the present invention permits rapid disassembly, as well as assembly, by relatively unskilled persons. For a display rack that is to be used at a trade show or other temporary location, transport to and from such a location is a major consideration. That is, not only must a display rack be relatively light but must also be relatively compact in its stored state to permit ease of transport an storage.

Figure 2:
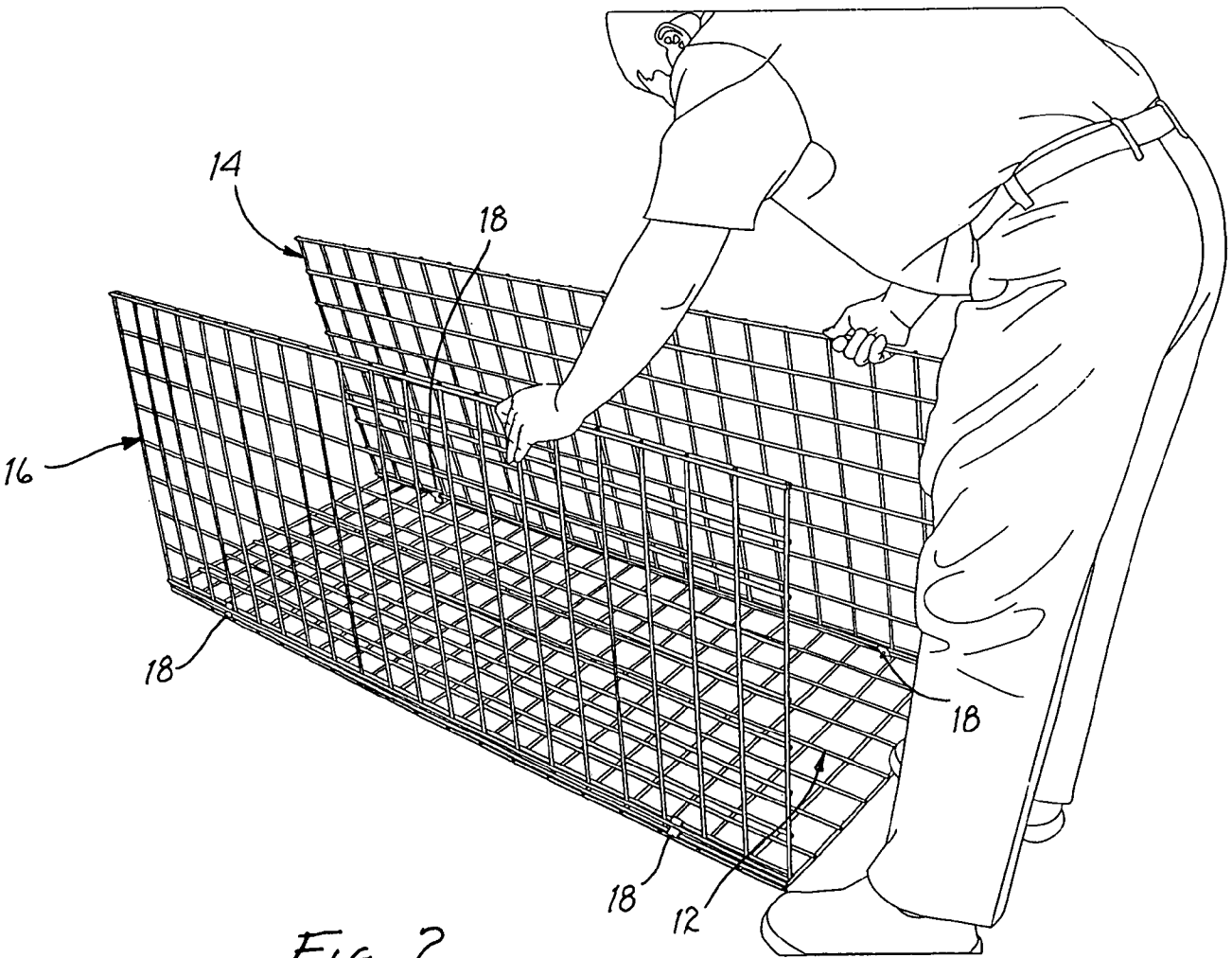
FIG. 2 illustrates a step of unfolding a pair of side grid walls hingedly attached to a back grid wall.
Figure 3:
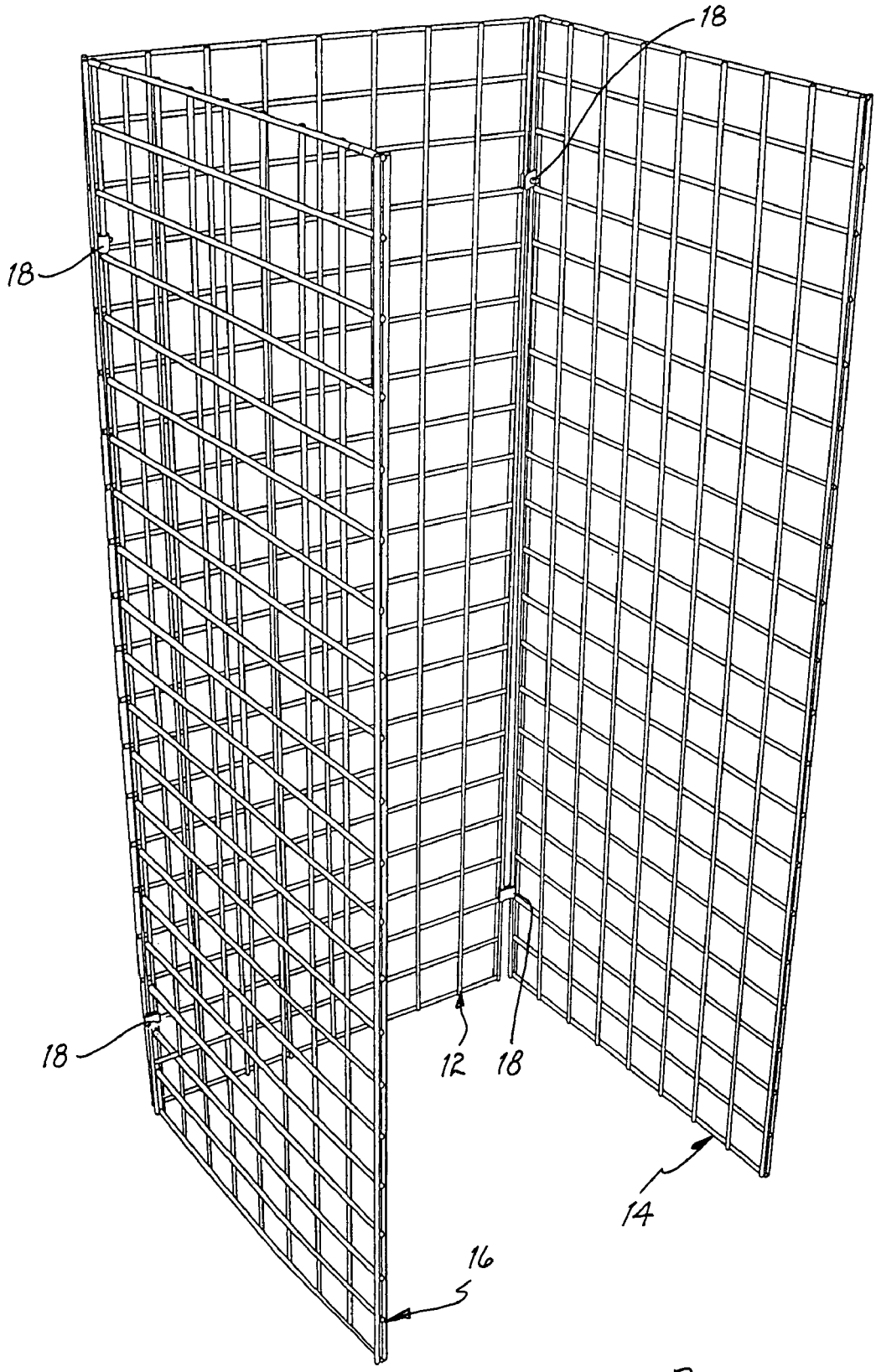
FIG. 3 illustrates the back and side grid walls of the display rack prior to attachment of shelves.
Figure 5:
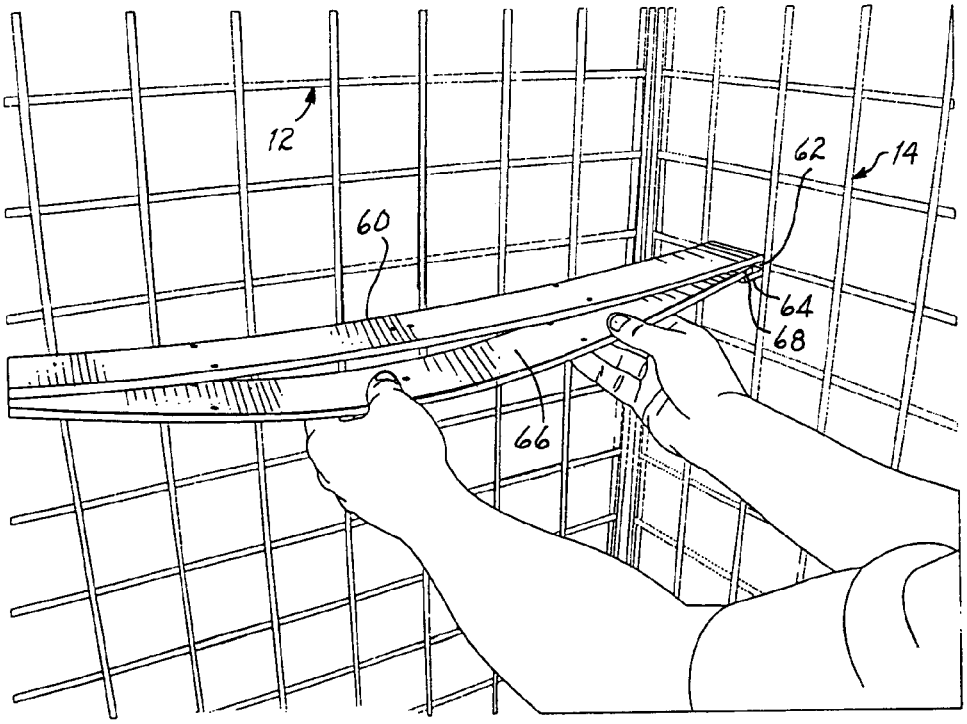
FIG. 5 illustrates attachment of a second strap with the first strap to lock wire elements within the first strap.

Prior to use, or while in storage, side grid walls 14 and 16 are pivotally positioned adjacent the back grid wall to provide an essentially planar unit during non use. As particularly shown in FIGS. 2 and 3, assembly of display unit 10 begins by pivoting side grid wall 14 upwardly by operation of hinges 18 interconnecting the side grid wall with back grid wall 12. Similarly, side grid wall 16 is pivoted upwardly. After such pivotal movement, the three grid walls will be positioned, as depicted in FIG. 3. After erection of side grid walls 14, 16, as shown in FIG. 3, a first strap 60 of a strap unit is hooked onto a wire segment 62 of one of the side grid walls such as side grid wall 16. First strap 60 includes a folded over end 64 dimensioned to snugly to receive wire segment 62 therewithin. As shown in FIG. 5, after attachment of first strap 60, a second strap 66 is put in place. Strap 66 is dimensioned to have its ends, such as end 68, nest within folded over end 64 of first strap 60 and bear snugly against wire segment 62. As shown in FIG. 5, second strap 66 has to be slightly bent in order to fit it within the folded over ends of first strap 60. After such assembly, second strap 66 will lock first strap 60 in place and prevent relative movement between the first strap and either of side grid walls 14, 16.

Figure 6:
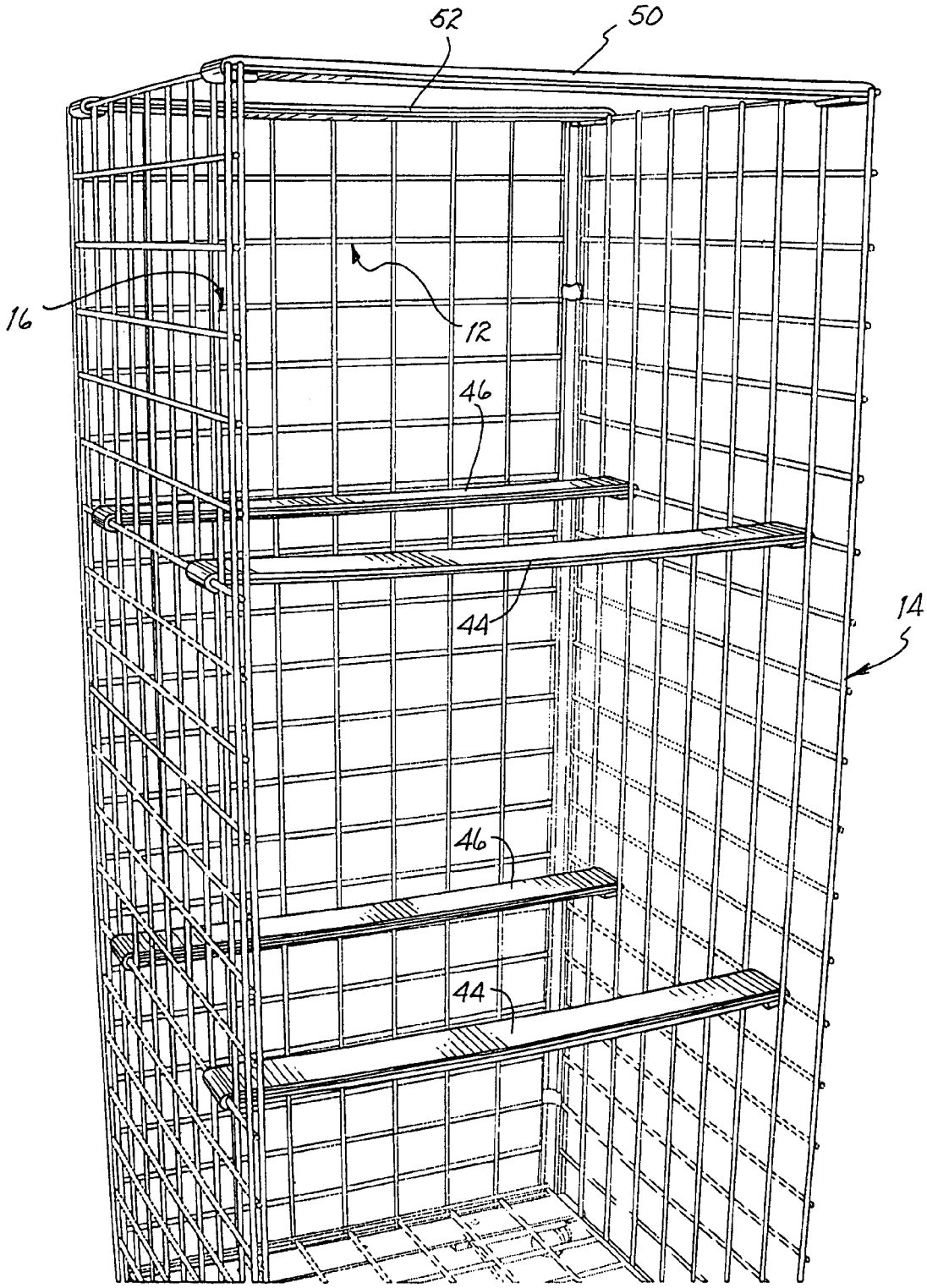
FIG. 6 illustrates three pairs of first and second straps attached to side grid walls to rigidly position the side grid walls relative to the back grid wall.
Figure 7:
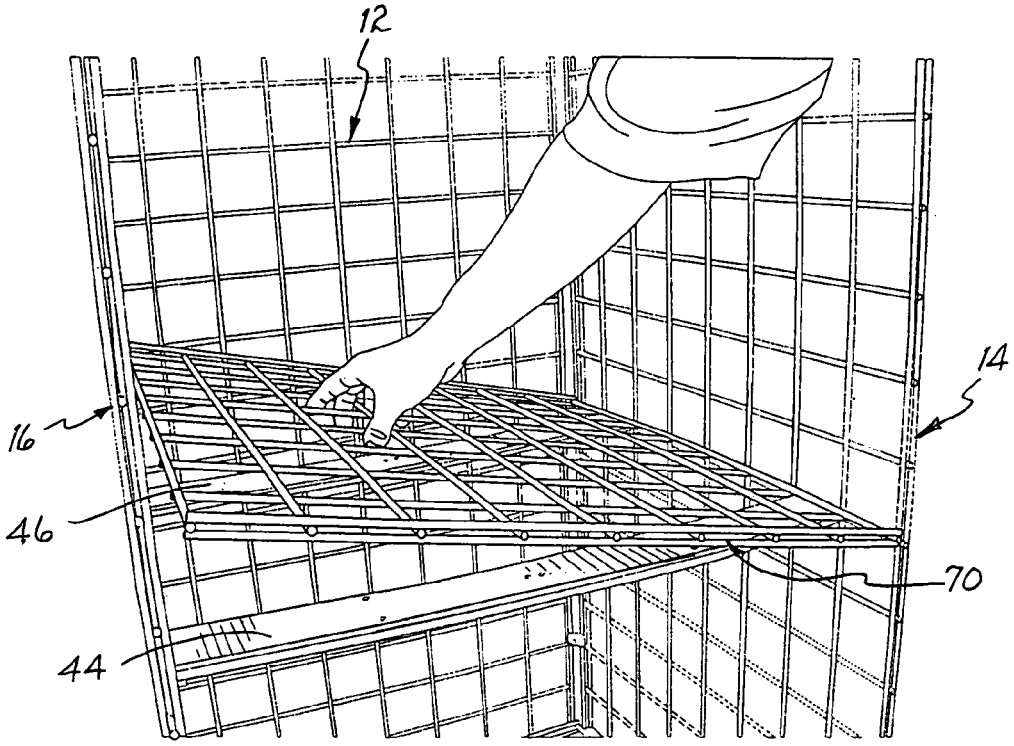
FIG. 7 illustrates the laying of a shelf upon two pairs of first and second straps.

As shown jointly in FIGS. 1 and 6, pairs of strap units 44, 66 are located at different heights along side grid walls 14, 16. After mounting of strap units 44, 46, a shelf 70 is placed upon strap units 44, 46 at a common height, as shown in FIG. 7.

Figure 4:
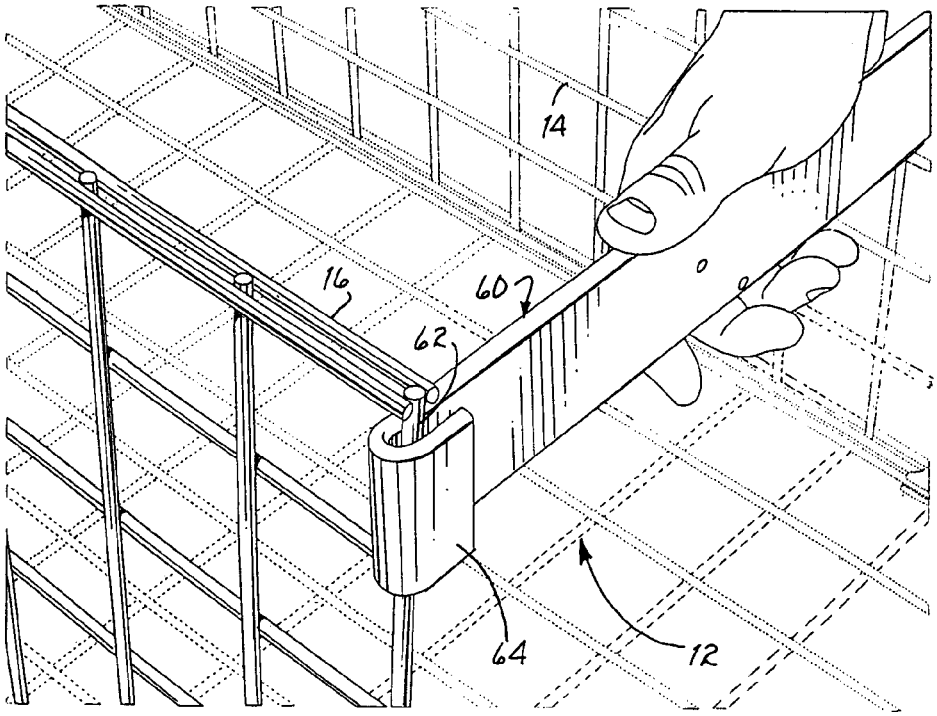
FIG. 4 illustrates attachment of a first strap to a wire element.
Figure 8:
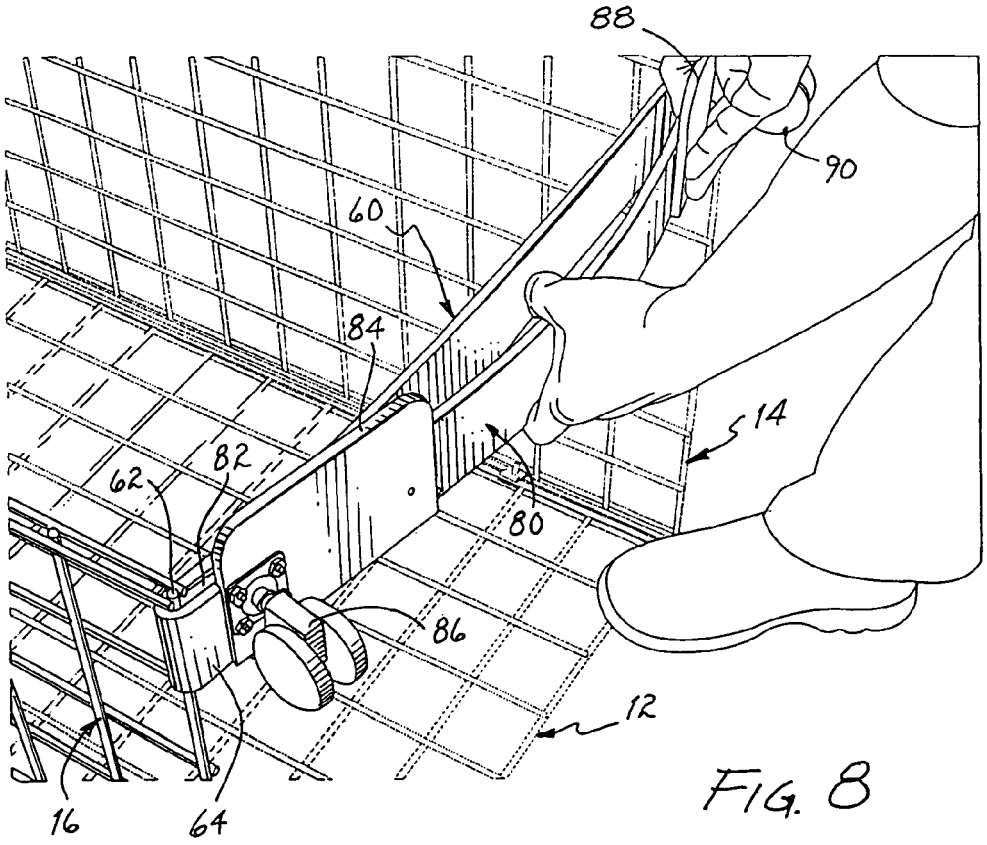
FIG. 8 illustrates the attachment of a second strap having a pair of wheels extending therefrom for mechanical attachment to a first strap secured to a wire element at the bottom of the side grid walls.
Figure 9:
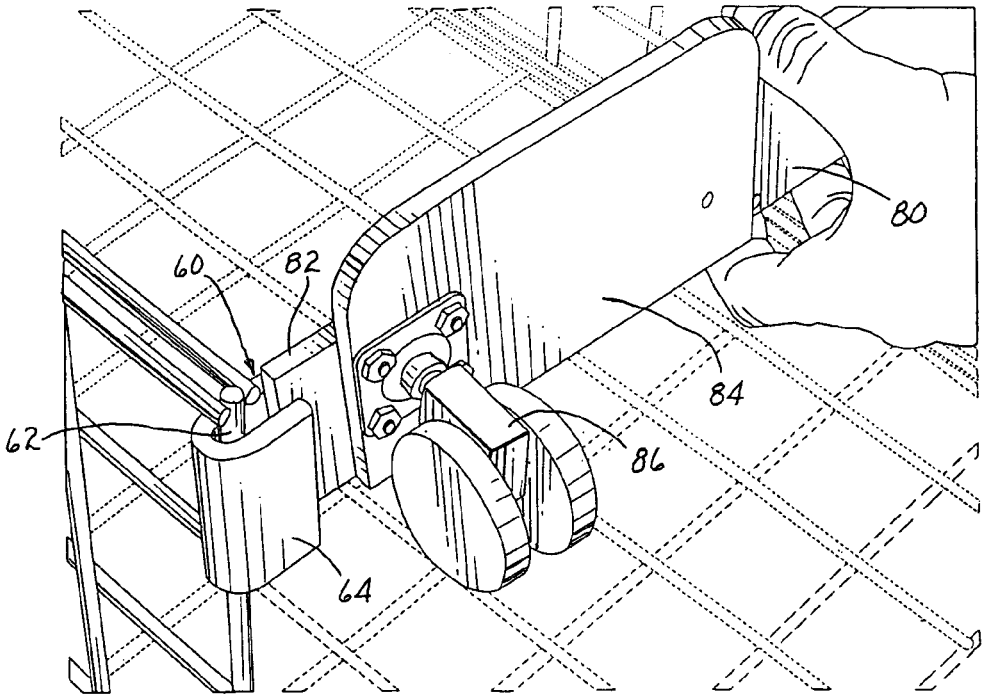
FIG. 9 illustrates completion of the step shown in FIG. 8.
Figure 10:
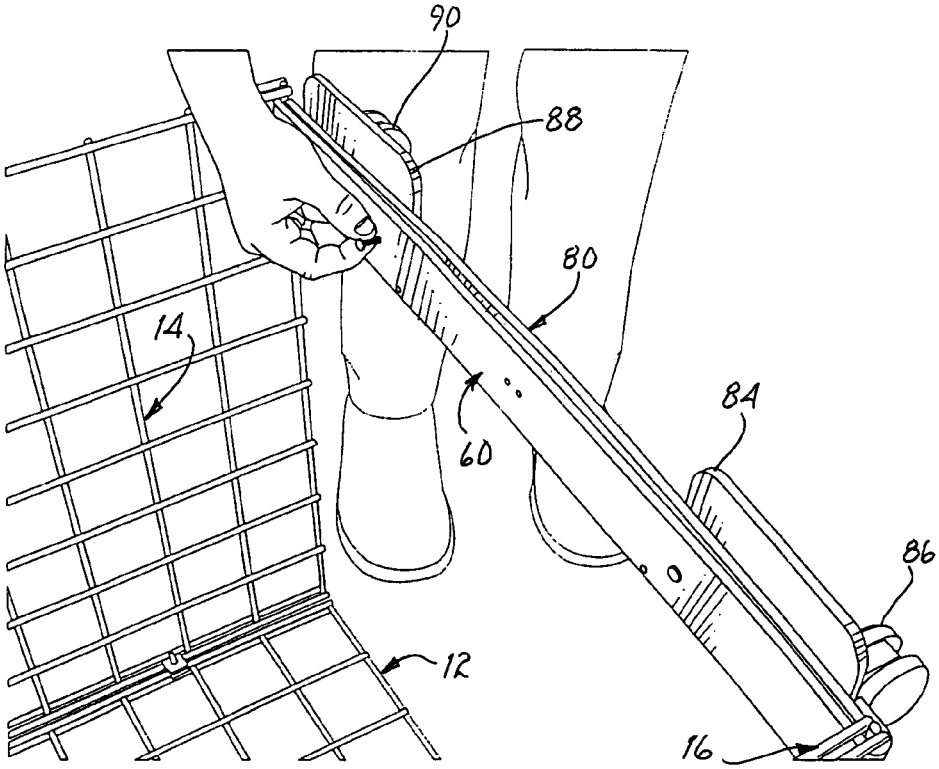
FIG. 10 illustrates attachment of the second strap supporting a pair of wheels to the first strap with bolts or pins to obtain locking engagement therebetween.

As discussed above with respect to FIGS. 4 and 5, a first strap 60 is secured to wire segment 62 of side grid wall 16. Although not shown, the other end of first strap 60 is secured to a corresponding wire segment of side grid wall 14. As illustrated in FIGS. 8, 9 and 10, first strap 60 is secured to the bottom edge of the side grid walls. A second strap 80 is attached to first strap 60 in the manner of second strap 66 discussed with respect to FIG. 5. That is, it is bent, as shown, to insert end 82 within folded over end 64 of first strap 60. The other end of second strap 80 is similarly inserted into the corresponding folded over end of first strap 60. After the second strap is released, it will be essentially adjacent the first strap in a planar relationship and each of ends 82 will bear against the corresponding wire segment. Thereby, side grid walls 14 and 16 are locked by the combination of first and second straps 60, 80.

Second strap 80 includes a platform 84 supporting a pivotally mounted pair of wheels 86, which platform is disposed at one end of the second strap. A further platform 88 supports a further pair of wheels 90 and is attached to the opposite end of second strap 80. As particularly shown in FIG. 10, second strap 80 may be rigidly secured to first strap 60 by one or more bolts penetrating the first strap into threaded engagement with the second strap or into threaded engagement with a nut bearing against the second strap.

Figure 11:
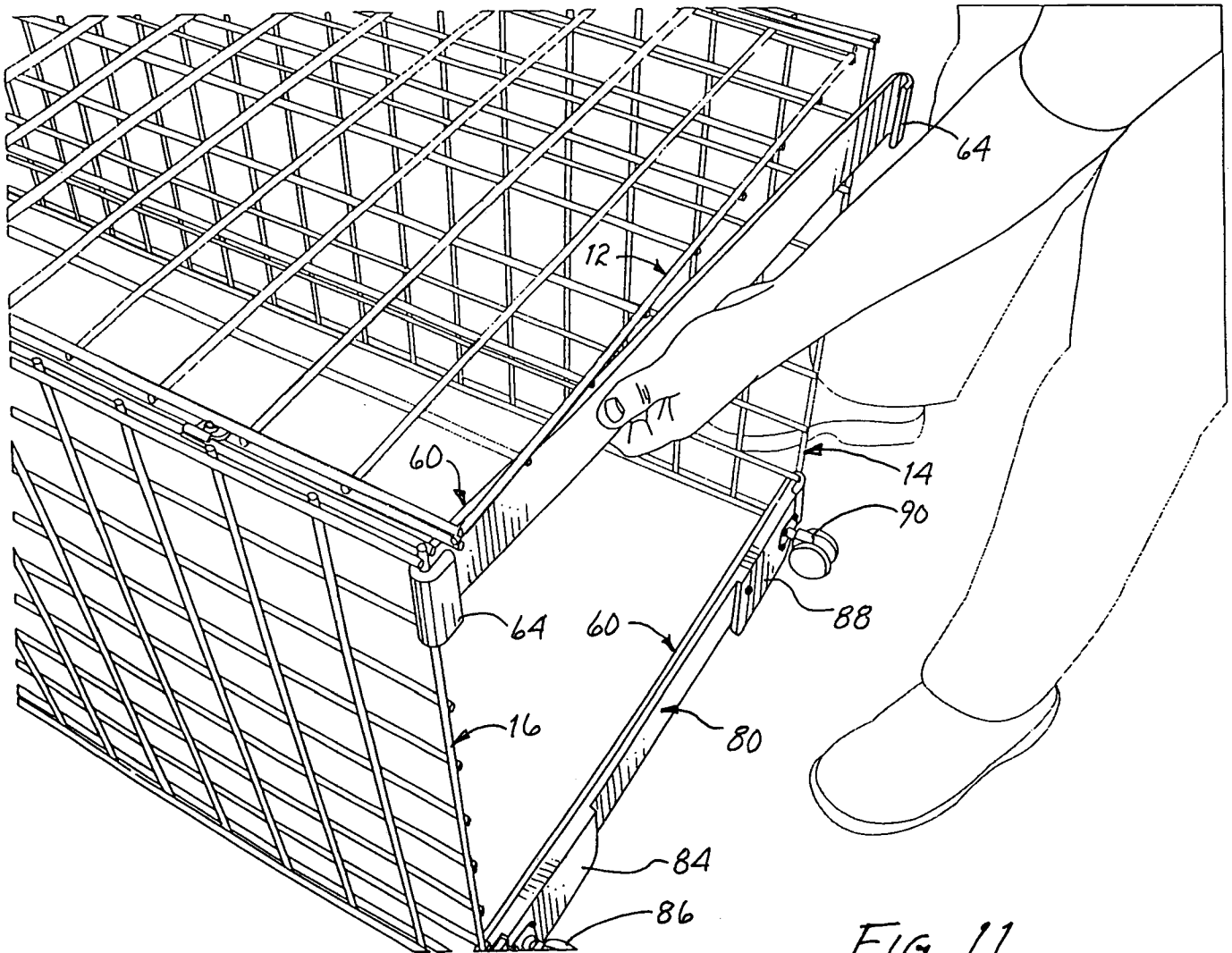
FIG. 11 illustrates attachment of a first strap adjacent the rear panel to ultimately support a further second strap having a pair of wheels depending therefrom.
Figure 12:
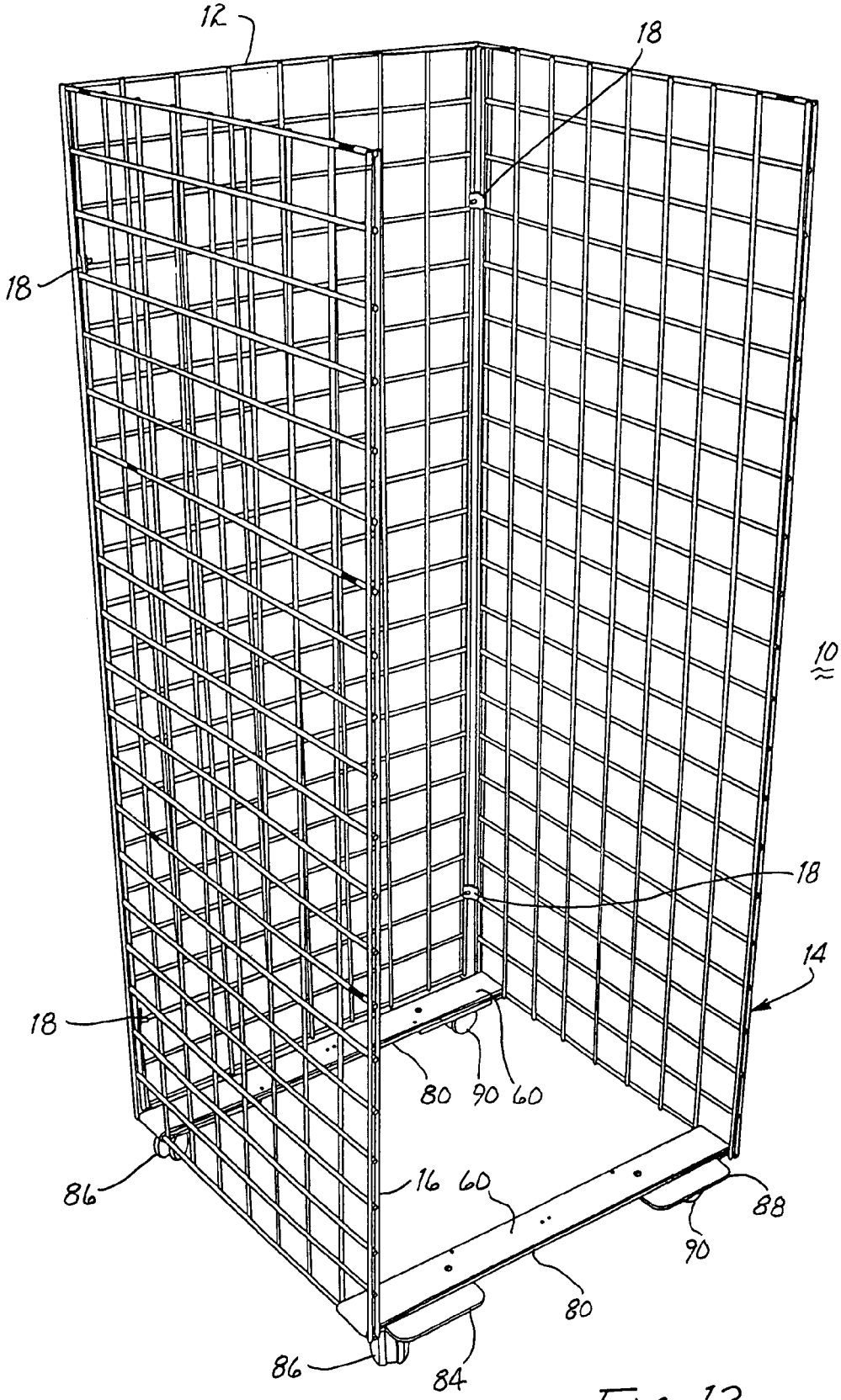
FIG. 12 illustrates the three grid walls of the display rack with the pairs of straps supporting the wheels.

FIG. 11 illustrates the attachment of a further first strap 60 secured to side grid walls 14, 16 adjacent the edge of back grid wall 12. After attachment of this first strap, a further second strap 80 is attached, as described above. After attachment of the wheel supporting first and second straps, display unit 10 will be erect and moveable, as particularly shown in FIG. 12.

Figure 13:
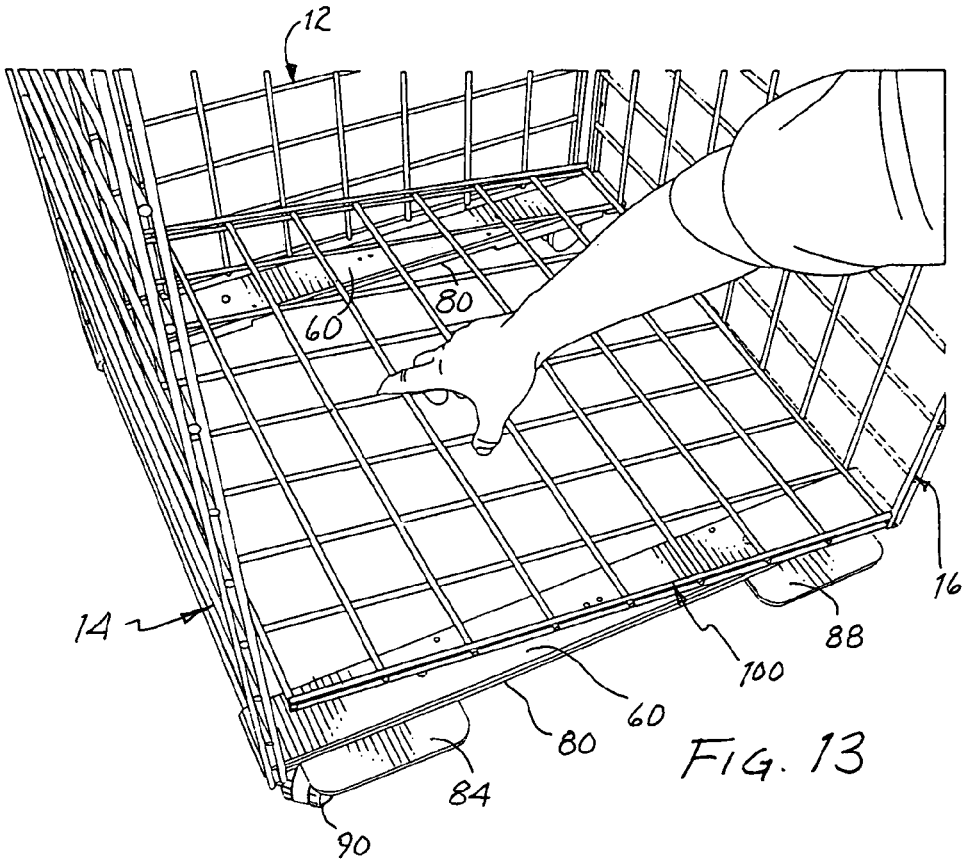
FIG. 13 illustrates placement of a shelf upon the wheel supporting pairs of straps.
Figure 14:
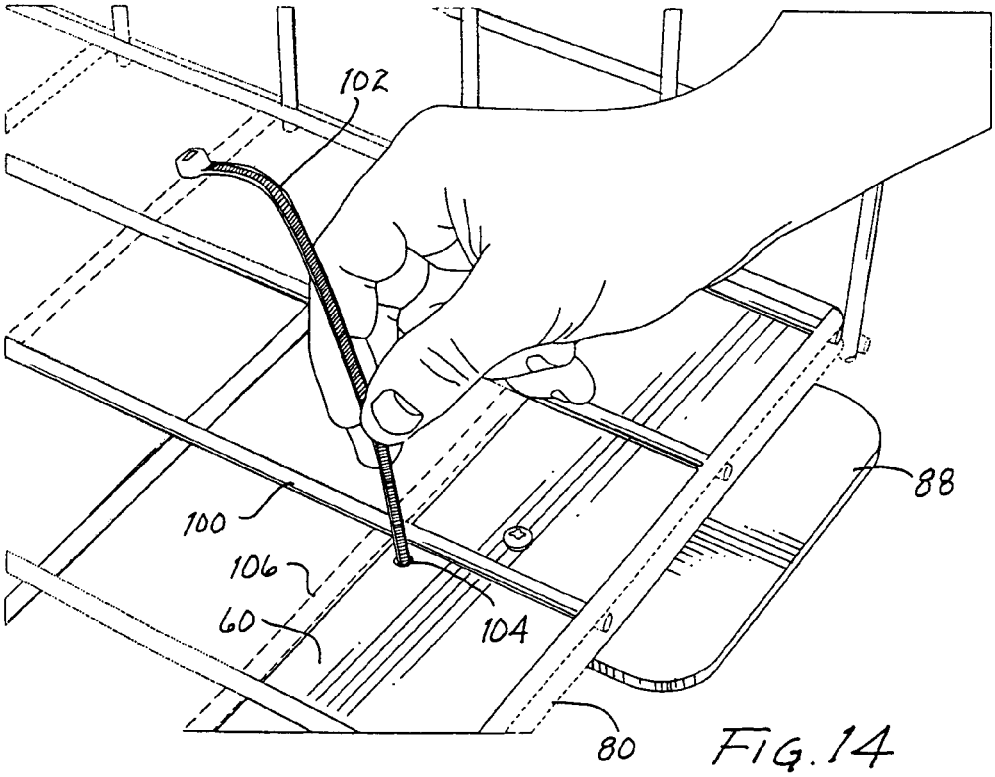
FIGS. 14 and 15 illustrates attachment of the shelf to the wheel supporting straps.
Figure 15:
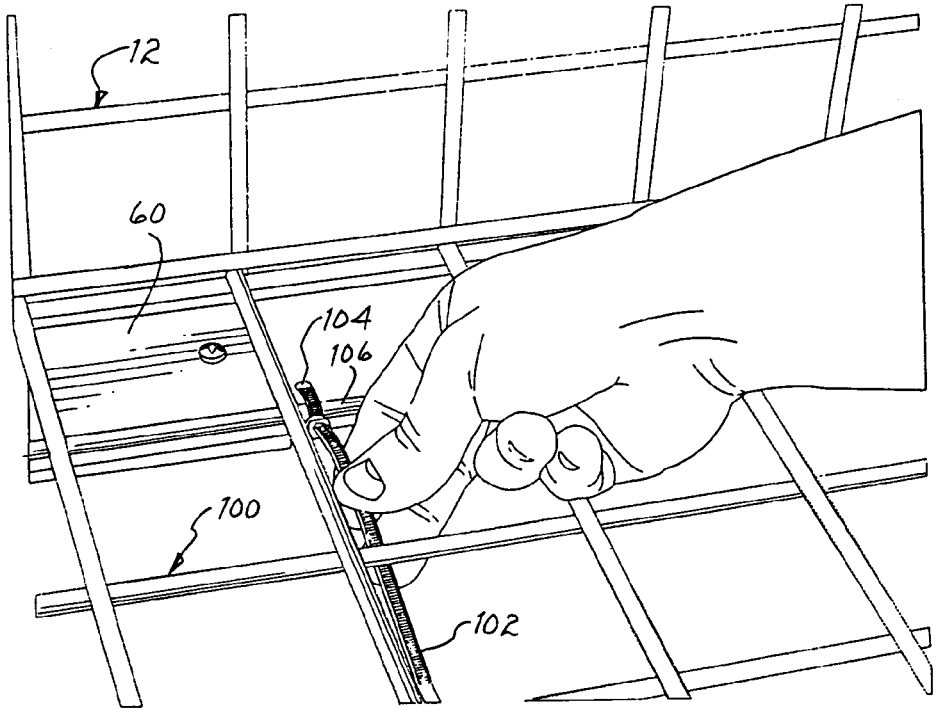

As shown in FIGS. 13, 14 and 15, a shelf 100 of grid wall material is laid upon the wheel supporting straps and receives support therefrom. The shelf is secured to first and second straps 60, 80 by a nylon tie 102, as illustrated in FIGS. 14 and 15. The nylon tie penetrably engages the first and second straps through an aperture 104 and is wrapped about a wire member 106. A plurality of nylon ties 102 may be used to secure the shelf with the first and second straps at the front of the display unit. Similarly, nylon ties may be used to secure the shelf to the first and second strap units located adjacent the back grid wall.

Figure 16:
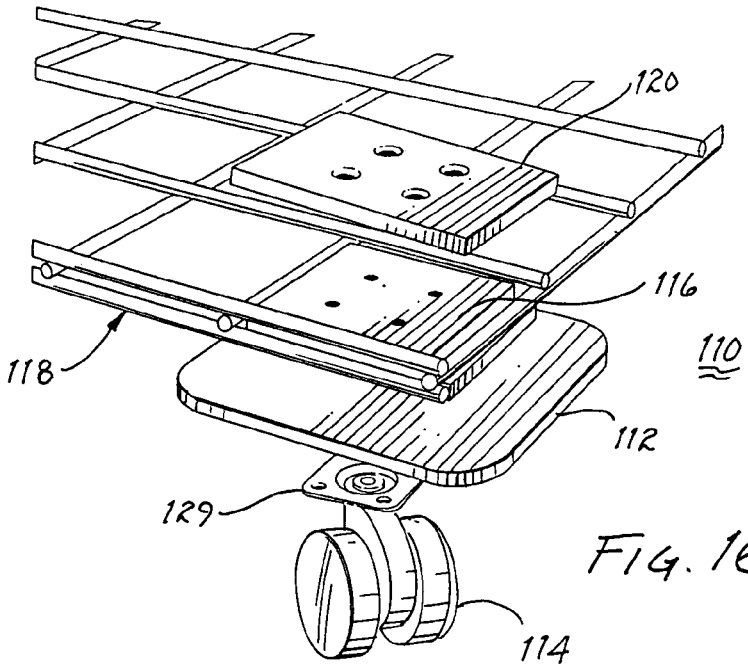
FIGS. 16 and 17 illustrate alternate wheel assemblies for attachment to the bottom shelf.
Figure 17:
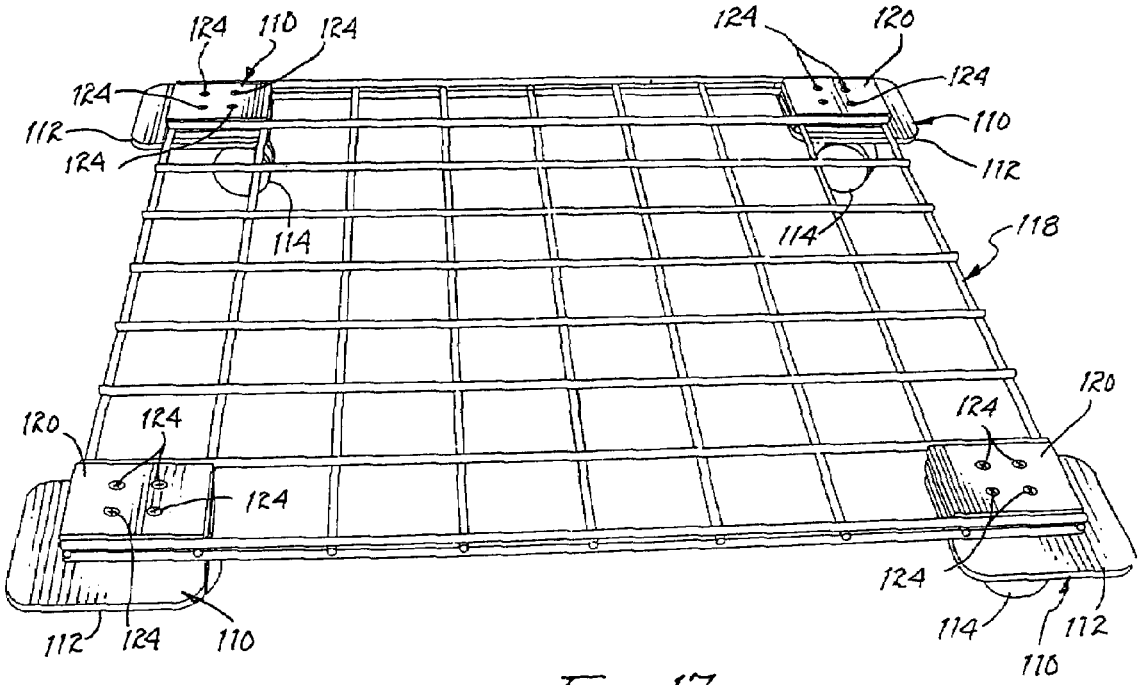
Figure 18:
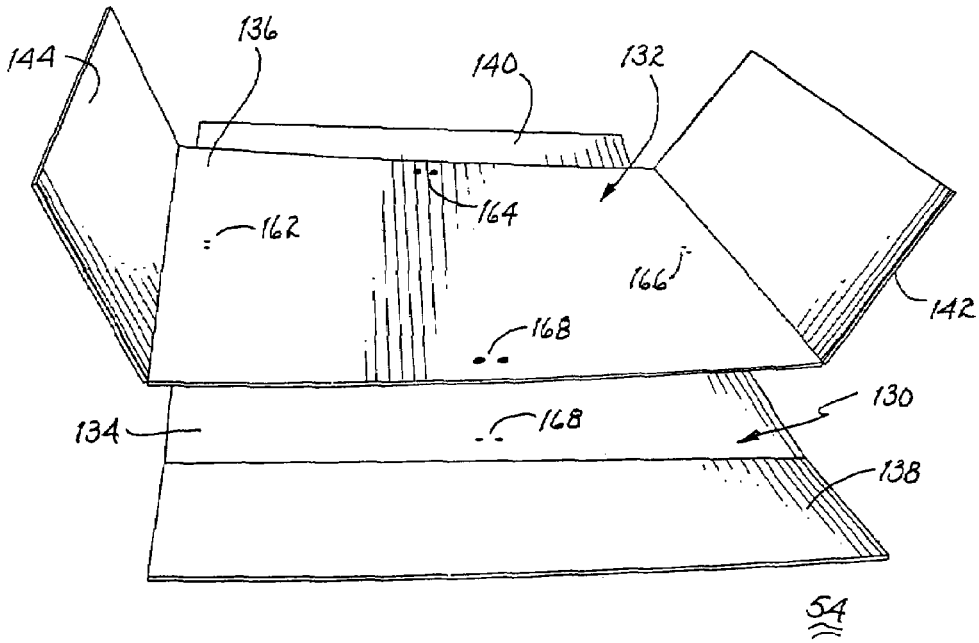
FIG. 18 illustrates the components of a billboard unit.
Figure 19:
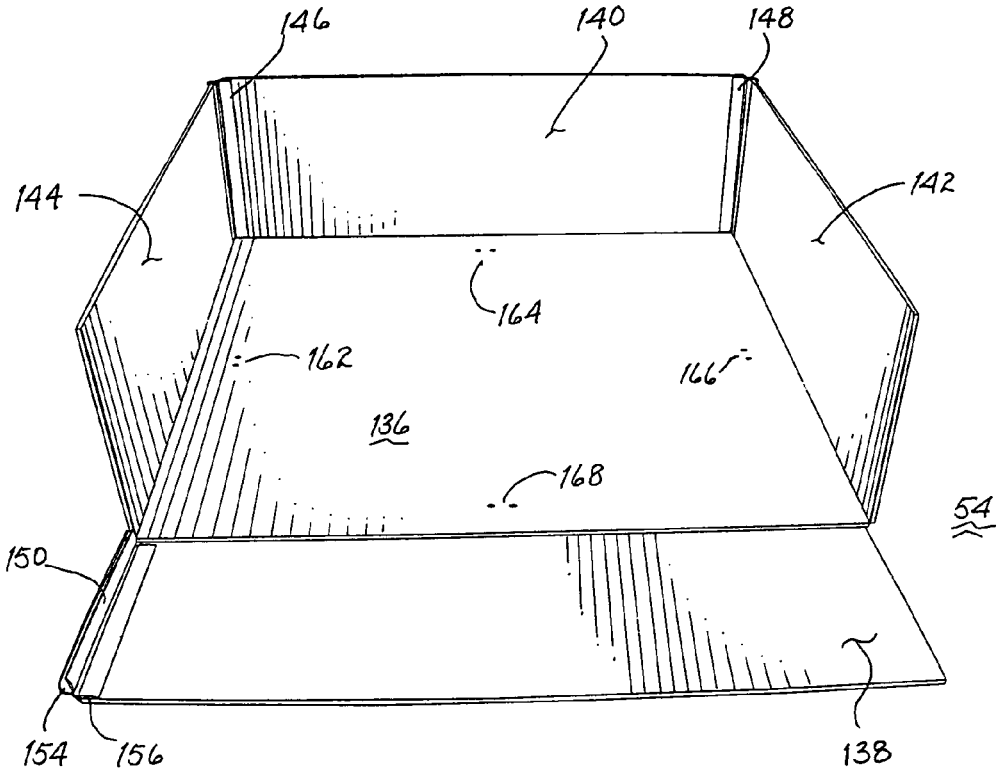
FIGS. 19 and 20 illustrates assembly of the billboard unit.
Figure 20:
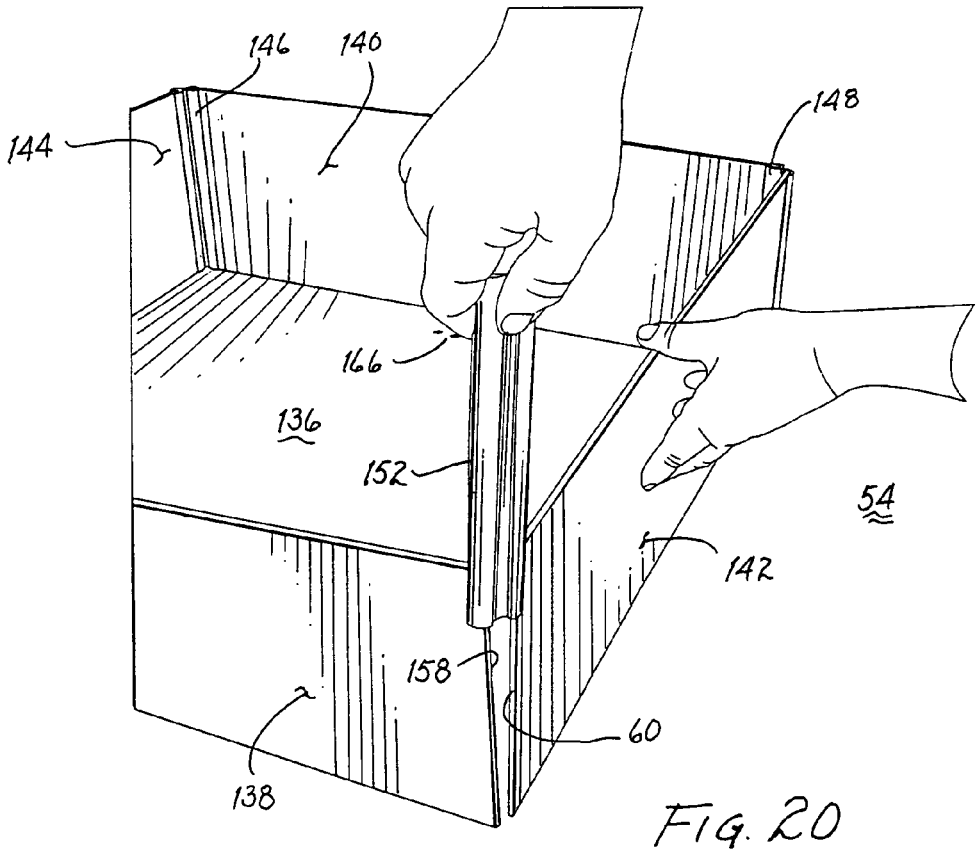
Figure 21:
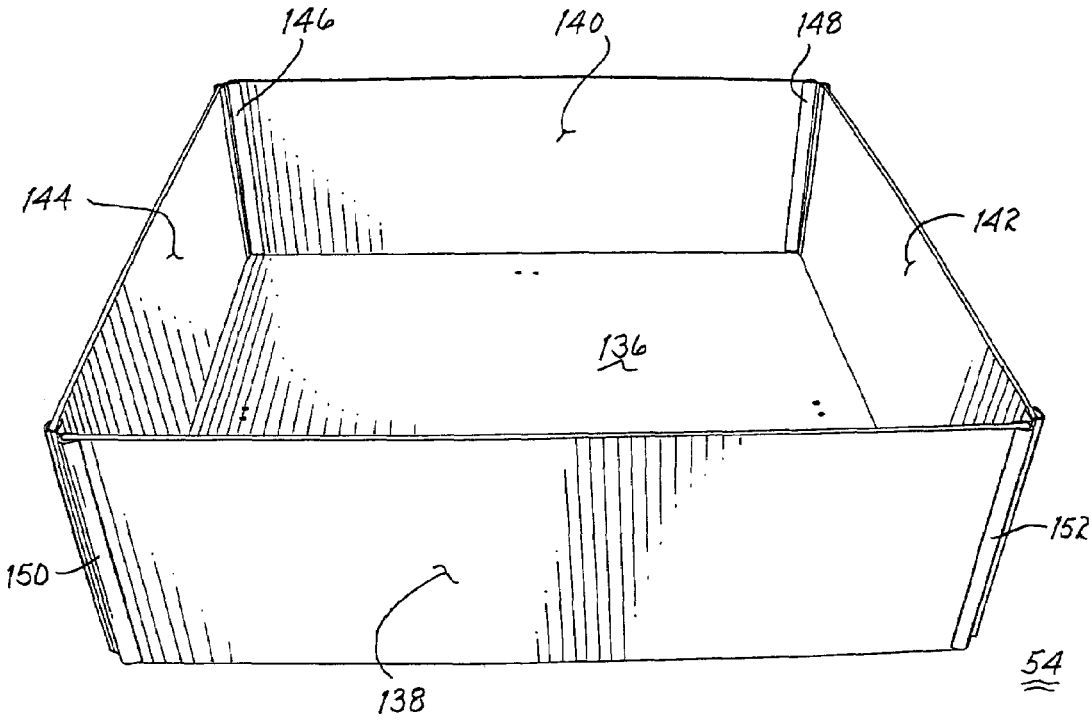
FIG. 21 illustrates the assembled billboard unit ready for attachment to the top of the display rack.

Referring jointly to FIGS. 16 and 17, an alternate mounting apparatus for supporting the pivotable wheels may be used. The alternate mounting apparatus includes a platform 1 12 supporting a pivotable wheel 114. A spacer 116, sized for placement within a square of wire elements of shelf 118 supports a plate 120. A plurality of bolts extend through the plate, the spacer, the platform and a bracket 122 formed as part of wheel 114 into engagement with a nut. Upon tightening the machine screw or bolt, the penetrably engaged elements will be drawn toward one another and mounting apparatus 110 will clamp shelf 118. As particularly shown in FIG. 17, four countersunk machine screws or bolts 124 may be used with each mounting apparatus. Alternatively, nylon ties may be used for this purpose, depending upon the expected degree of strength required.

Referring jointly to FIGS. 18, 19, 20 and 21, the assembly of billboard unit 54 (see FIG. 1) will be described. The billboard unit includes two three segment panels 130, 132. Panel 132 is laid orthogonally across center section 134 of panel 130 and panel 136 is equivalent in size to panel 134. Each of end panels 138, 140, 142 and 144 is bent upwardly to a location essentially perpendicular to respective panels 134, 136. Upon such bending, the lateral edges of orthogonally oriented end panels will be essentially joined. To retain the end panels in the upright position illustrated, slides 146, 148, 150 and 152 are used. Each of these slides includes a pair of longitudinal channels 154, 156, oriented orthogonal to one another. Each of slides 146, 148, 150 and 152 is brought into engagement with the edges of the respective pair of end panels. As particularly shown in FIG. 20, such engagement is effected by channel 154 (see FIG. 19) engaging edge 158 of end panel 138 and channel 156 engaging edge 160 of end panel 142. Thereby, adjacent end panels are retained in the vertical position and provide surfaces for advertising or the like, as particularly illustrated in FIG. 1.

The billboard unit is secured to the top of display rack 10 by nylon ties penetrably engaging each of pairs of apertures 162, 164, 166 and 168 and an underlying wire element of a grid wall or shelf.

By the above description, it becomes self evident that assembly of display rack 10 is easily performed by anyone with a modicum of skill. Moreover, no tools of any type are necessary to effect assembly. By use of first and second strap units described above, robustness of the display unit is readily achieved without the need for any adjustments or other tightening mechanisms. The use of nylon ties to secure the shelves to their respective pairs of first and second strap units is a simple and effective way to lock the shelves in place. Moreover, the resulting mechanical engagement between each shelf and its supporting pair of first and second strap units add rigidity to the structure. Furthermore, the billboard unit is rapidly assembled and easily secured in place with nylon ties.

During disassembly, each of the nylon ties is snipped with a pair of dikes or the like and the released parts are quickly removed. To disengage the first and second strap units, each second strap is bent (see FIG. 5) to withdraw the ends of the second strap from the folded over ends of the first strap. When all elements attached to the side grid walls and the back grid wall are removed, the side walls are folded over the back grid wall.

The billboard unit is similarly disassembled by slidably removing each of the slides. After removal of the nylon ties securing the billboard unit to the display unit, the three segment panels are flattened. The resulting combination of elements are easily and compactly stored in a box or container for transport and storage purposes.

I claim:

1. A rapidly assembleable and disassembleable display rack, said display rack comprising in combination:

a) a pair of side grid walls pivotally attached to a back grid wall;

b) a first strap unit including a first strap having ends folded over to engage a wire element therewithin of said pair of side grid walls and a second strap having opposed ends dimensioned for sliding removable insertion within respective ones of said folded ends to retain each engaged wire element within one of said folded ends and to prevent withdrawal of the wire element while said second strap is in place within said folded over ends;

c) a second one of said strap units secured to said side grid walls spaced apart from and at the same elevation as said first strap unit;

d) a shelf of grid wall material resting upon said first and second strap units; and e) a plurality of nylon ties securing said shelf to said first and second strap units.

2. The display rack as set forth in claim 1, including a billboard unit mounted upon said display rack, said billboard unit comprising a pair of three segment panels placed orthogonal to one another, each of said three segment panels including a pair of end panels folded upwardly, a slider interconnecting the edges of a pair of said end panels abutting each other, and nylon ties securing said pair of three segment panels to at least one of said pair of side grid walls and said rear grid wall.

3. The display rack as set forth in claim 2 wherein each of said first and second straps of said first and second strap units, respectively, includes a pair of wheels supporting said display rack.

4. The display rack as set forth in claim 1, including third and fourth ones of said first strap unit and said second strap unit, respectively, secured to said side grid walls, a second shelf of grid wall material supported upon said third and fourth strap units, and a plurality of nylon ties securing said second shelf to said third and fourth strap units.

5. The display rack as set forth in claim 4, including a billboard unit mounted upon said display rack, said billboard unit comprising a pair of three segment panels placed orthogonal to one another, each of said three segment panels including a pair of end panels folded upwardly, a slider interconnecting the edges of a pair of said end panels abutting each other, and nylon ties securing said pair of three segment panels to at least one of said pair of side grid walls and said rear grid wall.

6. The display rack as set forth in claim 4, including fifth and sixth ones of said first strap unit and said second strap unit, respectively, secured to said side grid walls, a third shelf of grid wall material supported upon said fifth and sixth strap units, and a plurality of nylon ties securing said third shelf to said fifth and sixth strap units.

7. The display rack as set forth in claim 6, including a billboard unit mounted upon said display rack, said billboard unit comprising a pair of three segment panels placed orthogonal to one another, each of said three segment panels including a pair of end panels folded upwardly, a slider interconnecting the edges of a pair of said end panels abutting each other, and nylon ties securing said pair of three segment panels to at least one of said pair of side grid walls and said rear grid wall.

8. The display rack as set forth in claim 6 wherein each of said first and second straps of said first and second strap units, respectively, includes a pair of wheels supporting said display rack.

9. The display rack as set forth in claim 8, including a billboard mounted upon said display rack, said billboard unit comprising a pair of three segment panels placed orthogonal to one another, each of said three segment panels including a pair of end panels folded upwardly, a slider interconnecting the edges of a pair of said end panels abutting each other, and nylon ties securing said pair of three segment panels to at least one of said pair of side grid walls and said rear grid wall.

10. The display rack as set forth in claim 4 wherein each of said first and second straps of said first and second strap units, respectively, includes a pair of wheels supporting said display rack.

11. The display rack as set forth in claim 1 wherein each of said first and second straps of said first and second strap units, respectively, includes a pair of wheels supporting said display rack.

* * * * *